US010299349B2

(12) United States Patent
Rozendaal et al.

(10) Patent No.: US 10,299,349 B2
(45) Date of Patent: May 21, 2019

(54) SYNCHRONOUS CONTROL OF NETWORKED LIGHTING DEVICES

(71) Applicant: SIGNIFY HOLDING B.V., Eindhoven (NL)

(72) Inventors: Leendert Teunis Rozendaal, Valkenswaard (NL); Aloys Hubbers, Eindhoven (NL); Antonie Leonardus Johannes Kamp, Eindhoven (NL); Marcel Lambertus Leonardus Bijsterveld, Geldrop (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 15/524,857

(22) PCT Filed: Nov. 5, 2015

(86) PCT No.: PCT/EP2015/075779
§ 371 (c)(1),
(2) Date: May 5, 2017

(87) PCT Pub. No.: WO2016/071432
PCT Pub. Date: May 12, 2016

(65) Prior Publication Data

US 2018/0288851 A1 Oct. 4, 2018

Related U.S. Application Data

(60) Provisional application No. 62/076,837, filed on Nov. 7, 2014.

(30) Foreign Application Priority Data

Mar. 27, 2015 (EP) ..... 15161276

(51) Int. Cl.
*H05B 37/02* (2006.01)
*H05B 33/08* (2006.01)

(52) U.S. Cl.
CPC ..... *H05B 37/0245* (2013.01); *H05B 37/029* (2013.01); *H05B 33/0863* (2013.01); *H05B 37/0227* (2013.01); *H05B 37/0272* (2013.01)

(58) Field of Classification Search
CPC ..... H05B 37/0272; H05B 37/0227
See application file for complete search history.

(56) References Cited

U.S. PATENT DOCUMENTS

2005/0231134 A1 10/2005 Sid
2006/0082331 A1 4/2006 Ashdown
(Continued)

FOREIGN PATENT DOCUMENTS

EP 2475227 A1 7/2012
WO 2013128353 A2 9/2013

*Primary Examiner* — Thuy V Tran
(74) *Attorney, Agent, or Firm* — Meenakshy Chakravorty

(57) ABSTRACT

A method, device and computer program product for (near) synchronous control of networked lighting devices is presented. In networked lighting systems, a control command sent to the networked lighting devices is limited in length and as such it is not always possible to include the identifiers of the networked lighting devices, as well as the color point and/or intensity level they should change to in a single control command. However, sending multiple control commands in sequence can result in the undesired effect that these lighting devices change light output out-of-sync. The invention proposes to determine an approximate color point and/or approximate intensity level in, respectively, a color space and/or intensity space of a lower resolution. This allows a control command to comprise the identifiers of the networked lighting devices, as well as the approximate color point and/or approximate intensity level for (near) synchronous control of the networked lighting devices.

11 Claims, 8 Drawing Sheets

(56) References Cited

U.S. PATENT DOCUMENTS

| | | | | |
|---|---|---|---|---|
| 2012/0229048 | A1* | 9/2012 | Archer | H05B 37/0245 315/297 |
| 2013/0285572 | A1 | 10/2013 | Saes | |
| 2013/0285574 | A1 | 10/2013 | Garcia Morchon et al. | |
| 2017/0150582 | A1* | 5/2017 | Clout | H05B 37/0254 |

* cited by examiner

SYNCHRONOUS CONTROL OF NETWORKED LIGHTING DEVICES

CROSS-REFERENCE TO PRIOR APPLICATIONS

This application is the U.S. National Phase application under 35 U.S.C. § 371 of International Application No. PCT/EP2015/075779, filed on Nov. 5, 2015 which claims benefit of European Patent Application No. 15161276.9, filed on Mar. 15, 2015, which claims the benefit of U.S. Patent Application No. 62/076,837,filed on Nov. 7, 2014. These applications are hereby incorporated by reference herein.

FIELD OF THE INVENTION

The present invention relates to methods, control devices and computer program products for (near) synchronous control of networked lighting devices.

BACKGROUND OF THE INVENTION

Networked lighting devices offer remote control of light effects that are to be rendered. As the number of networked lighting devices in a home, an office, etc. grows, new user demands arise. As an example, it is undesirable when a user executing a scene change results in the lamps in the ceiling pendants changing color before the lamps in the wall mounted luminaires change color. Although timed lighting commands in combination with a global clock used by all networked lighting devices can resolve this issue, this requires any of: increased processing overhead for controlling the networked lighting devices, additional or more complex components in networked lighting devices, etc. In a networked lighting system comprising multiple networked lighting devices, there is therefore a need for controlling such networked lighting devices (nearly) in-sync in a simplified manner.

SUMMARY OF THE INVENTION

The inventors have realized that in networked lighting systems, lighting control commands have a maximum length and as such only a limited number of networked lighting devices can be controlled to change color or intensity in a single command. When multiple networked lighting devices need to change color or intensity, multiple control commands are sent resulting in the controlled networked lighting devices adjusting their light output out-of-sync. It is an object of the present invention to provide a method, a device and a computer program product for (near) synchronous control of networked lighting devices. In a first aspect of the invention, a method is provided for near synchronous control of networked lighting devices, the method comprises receiving a target color point, in a target color space having a target color space resolution, and/or a target intensity level, in a target intensity space having a target intensity space resolution, and further receiving identifiers for networked lighting devices that are to be synchronously controlled to emit light based on the target color point and/or target intensity level. A color space is a specific organization of colors and can comprise, for example, all colors of visible light, all colors that can be rendered by the networked lighting device or all hues of the color red. A color space resolution is the granularity of a mapping of color points to the color space. For example, if the color space resolution is 3 bits, then 8 color points within the color space are selectable (e.g. purple, mauve, blue, green, yellow, orange, red, white). If the color space resolution is only 2 bits, then 4 color points within the color space are selectable (e.g. blue, green, red, white). If the color space resolution is 2 bits and the color space comprises all hues of the color red, then the color points that are selectable can be different from the previous example (e.g. pink, raspberry, crimson, carmine). Through color mapping, for example, a value can be associated with a color point (e.g. binary value "10" is associated with crimson) or a color point can be indicated by, for example, X,Y-coordinates in a color space. Similar examples will be valid for the intensity level, intensity space and intensity space resolution.

The method further comprises determining that a target control command based on the received identifiers of the networked lighting devices and the received target color point and/or the received target intensity level will exceed a maximum control command length. Specifications for control commands (e.g. ZigBee Light Link specifications) or network limitations (e.g. maximum packet size in WiFi) place a limitation on the size of a control command. This results in the fact that the identifiers of a limited number of networked lighting devices can be comprised in a single control command. The control command will further comprise color and/or intensity information that is used to control the light output of the networked lighting devices. A control command may further comprise overhead, such as a prefix, message sequence numbers, etc. When not all networked lighting devices can be controlled through the same control command, multiple control commands are typically sent and this results in the networked lighting devices not changing their light output synchronously.

The method further comprises:

- determining an approximate color space resolution, relating to an approximate color space, of a lower resolution than the target color space resolution, and/or an approximate intensity space resolution, relating to an approximate intensity space, of a lower resolution than the target intensity space resolution, based on the number of networked lighting devices that are to be synchronously controlled, and further based on the maximum control command length,
- determining an approximate color point in the approximate color space based on the target color point and/or an approximate intensity level in the approximate intensity space based on the target intensity level, and
- sending an approximate control command based on the received identifiers of the networked lighting devices that are to be synchronously controlled and the approximate color point and/or the approximate intensity level. By lowering the color space resolution and/or the intensity space resolution, the amount of data taken up by color and/or intensity information in a control command can be lowered and as such additional identifiers of networked lighting devices can be comprised in the control command. This allows more networked lighting devices to be controlled through a single control command.

In an embodiment of the method according to the invention, the approximate color space is equal to the target color space and/or the approximate intensity space is equal to the target intensity space. In a further embodiment the approximate color space is not equal to the target color space and/or the approximate intensity space is not equal to the target intensity space; and determining an approximate color space resolution is based on the received target color point and/or wherein determining an approximate intensity space resolution is based on the received target intensity level. It can be beneficial to lower the color space resolution, yet remain in the same color space. For example, when the color associated with the target color point is visually close to the color associated with the approximate color point (e.g. the target color point is blue out of: purple, mauve, blue, green, yellow, orange, red, white; and the approximate color point is blue out of blue, green, red, white). Yet it can also be beneficial to determine an approximate color space that is not equal to the target color space. For example, when the target color space comprises colors that cannot be rendered by the networked lighting devices, a different color space can be determined.

In an embodiment of the method according to the invention, the method further comprises determining the color difference between the received target color point and the current color point and/or the intensity difference between the received target intensity level and the current intensity level, of the networked lighting devices that are to be controlled; and determining an approximate color space resolution is further based on the color difference and/or wherein determining an approximate intensity space resolution is further based on the intensity difference. This embodiment is especially beneficial as, for example, a color change from red to crimson can be better facilitated by an approximate color space comprising all hues of red than by an approximate color space resolution comprising all colors of visible light.

In an embodiment of the method according to the invention, receiving a target color point and/or a target intensity level comprises receiving both a target color point and a target intensity level, and the method further comprises determining that the color difference between the received target color point and the current color point is below a predetermined color difference threshold; wherein determining the approximate color space resolution comprises determining the approximate color space resolution to be zero; and wherein the control command comprises the identifier of the networked lighting devices that are to be controlled and the approximate intensity level. In a further embodiment of the method according to the invention, receiving a target color point and/or a target intensity level comprises receiving both a target color point and a target intensity level, and the method further comprises determining that the intensity difference between the received target intensity level and the current intensity level is below a predetermined intensity difference threshold; wherein determining the approximate intensity space resolution comprises determining the approximate intensity space resolution to be zero; and wherein the single control command comprises the identifier of the networked lighting devices that are to be controlled and the approximate color point. These embodiments are particularly beneficial as by determining the color space resolution or intensity space resolution to be zero, because respectively the current color of light emitted by the networked lighting devices is close to or the same as the target color point or the current intensity of light emitted by the networked lighting devices is close to or the same as the target intensity level, no approximate color point respectively no approximate intensity level is comprised in the approximate control command. Minor differences in color and/or intensity of light emitted by a networked lighting device are hardly visible to the human eye.

In an embodiment of the method according to the invention, the method further comprises:

determining a ratio of color difference to intensity difference;

sending, to the networked lighting devices, a further control command when the determined ratio is above a predetermined threshold; wherein the control command comprises the identifier of the networked lighting devices that are to be controlled and the approximate color point; and wherein the further control command comprises the identifier of the networked lighting devices that are to be controlled and the approximate intensity level. In a further embodiment of the method according to the invention, the method further comprises:

determining a ratio of color difference to intensity difference;

sending, to the networked lighting devices, a further control command when the determined ratio is below a predetermined threshold; wherein the control command comprises the identifier of the networked lighting devices that are to be controlled and the approximate intensity level; and wherein the further control command comprises the identifier of the networked lighting devices that are to be controlled and the approximate color point. These embodiments are advantageous as to keep the appearance of synchronicity the networked lighting devices can first change color and then change intensity of their light output.

In an embodiment of the method according to the invention, the method further comprises:

determining a first set of networked lighting devices for which the color difference and/or intensity difference is below respectively a predetermined color difference threshold and/or a predetermined intensity level threshold, determining a second set of networked lighting devices for which the color difference and/or intensity difference is above respectively the predetermined color difference threshold and/or the predetermined intensity level threshold, sending, to the networked lighting devices, a further control command;

wherein the control command comprises the identifier of the networked lighting devices of the first set of networked lighting devices that are to be controlled, the approximate color point and/or the approximate intensity level; and wherein the further control command comprises the identifier of the networked lighting devices of the second set of networked lighting devices that are to be controlled, the approximate color point and/or the approximate intensity level. This embodiment is especially advantageous as those networked lighting devices whose color difference between the color and/or intensity of the current light output and respectively the target color point and/or target intensity level (or approximate color point and/or approximate intensity level) is large are controlled to change color and/or intensity of their light output first. This makes the color and/or intensity change over all the networked lighting devices that are controlled seem more in-sync.

In an embodiment of the method according to the invention, the networked lighting devices are part of a mesh network. An example of a mesh network is a ZigBee network.

In a second aspect of the invention, a control device is provided for synchronous control of networked lighting devices, the control device comprising:

a first interface for receiving a target color point, in a target color space having a target color space resolution, and/or a target intensity level, in a target intensity space having a target intensity space resolution, and further for receiving identifiers for each networked lighting device that are to be synchronously controlled based on the target color point and/or target intensity level, a processor for determining that a control command based on the received identifiers of the networked lighting devices and the received target color point and/or the received target intensity level, will exceed a maximum control command length, the processor further for determining an approximate color space resolution, relating to an approximate color space, of a lower resolution than the target color space resolution, and/or an approximate intensity space resolution, relating to an approximate intensity space, of a lower resolution than the target intensity space resolution, based on the number of networked lighting devices that are to be synchronously controlled, and further based on the maximum control command length, the processor further for determining an approximate color point in the approximate color space and/or an approximate intensity level in the approximate intensity space based on respectively the target color point and/or the target intensity level, a second interface for sending a control command based on the received identifiers of the networked lighting devices that are to be synchronously controlled and the approximate color point and/or the approximate intensity level. Such a control device provides the benefits of the method according to the invention and various embodiments of the control device can include features of the embodiments of the method according to the invention.

In an embodiment of the control device according to the invention, the first interface is an Application Programming Interface (API) and the second interface is a mesh network interface. Such an implementation can, for example, be provided through a bridge device that interfaces a first network, such as a Local Area Network, over which the API is offered and a second network, such as a ZigBee network, over which the control commands to control the networked lighting devices are controlled.

In a third aspect of the invention, a computer program product is provided for synchronous control of networked lighting devices, the computer program product comprising computer program code for executing the method of any one of claims 1 to 10 when the computer program code is run on a computer device.

It shall be understood that the (computer implemented) method, the control device and the computer program product, have similar and/or identical preferred embodiments, in particular, as defined in the dependent claims.

It shall be understood that where it is referred to synchronicity, this comprises near synchronicity, as explained in the summary above.

It shall be understood that a preferred embodiment of the invention can also be any combination of the dependent claims with the respective independent claim.

These and other aspects of the invention will be apparent from and elucidated with reference to the embodiments described hereinafter.

BRIEF DESCRIPTION OF THE DRAWINGS

To assist understanding of the present disclosure and to show how embodiments may be put into effect, reference is made by way of example to the accompanying drawings in which.

DETAILED DESCRIPTION OF EMBODIMENTS

Figure 1:
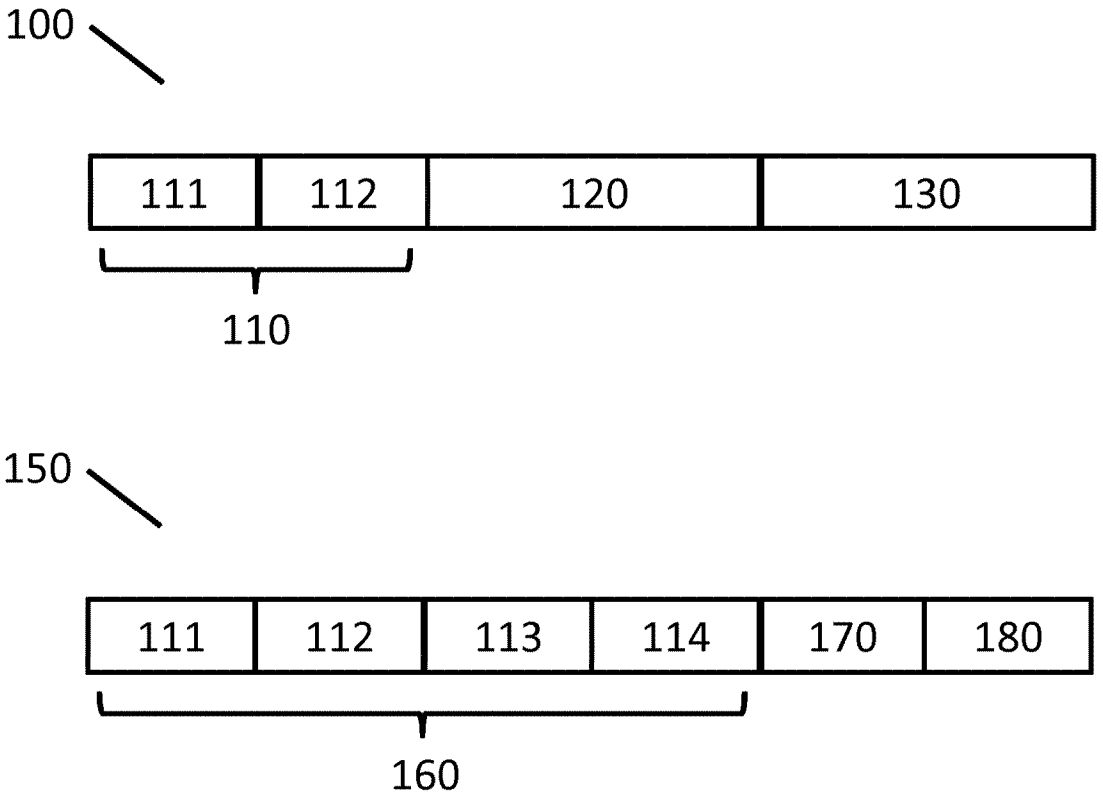
FIG. 1 shows schematically and exemplarily a target control command comprising a target color point and a target intensity level, and an approximate control command comprising an approximate color point and an approximate intensity level.

In FIG. 1 an example of a target control command 100 is shown, comprising the identifiers of two networked lighting devices 110 (i.e. networked lighting devices 111, 112), a target color point 120 and a target intensity level 130. Also, an example of an approximate control command 150 is shown, comprising the identifiers of four networked lighting devices 160 (i.e. networked lighting devices 111, 112, 113, 114), an approximate color point 170 and an approximate intensity level 180. The target color point 120 is, for example, provided as a 24 bit RGB color value, where each channel (i.e. each of: red, green and blue) is provided at an 8 bit depth. The target intensity level 130 is, for example, provided at a 24 bit depth. Given the maximum control command length, in this example 72 bits, there remain 24 bits for identifiers of networked lighting devices 110. As, in this example, the identifier of a networked lighting devices takes up 12 bits, only two networked lighting devices 111, 112 can be controlled through one control command 100.

By lowering the resolution of the color space or the intensity space, more networked lighting devices 111, 112, 113, 114 can be controlled through one control command 160. In this example, the color space resolution has been adapted such that a color point is provided as a 12 bit RGB color value and the intensity space resolution has been adapted such that an intensity level is provided at a 12 bit depth. An approximate color point 170 and an approximate intensity level 180 are comprised in the approximate control command 150.

Although the approximate color point and the approximate intensity level may not match the target color point and target intensity level, this is preferred over the use of multiple control commands. The approximate color point and the approximate intensity level can be selected to be as close to the target color point and the target intensity level as possible.

Figure 2:
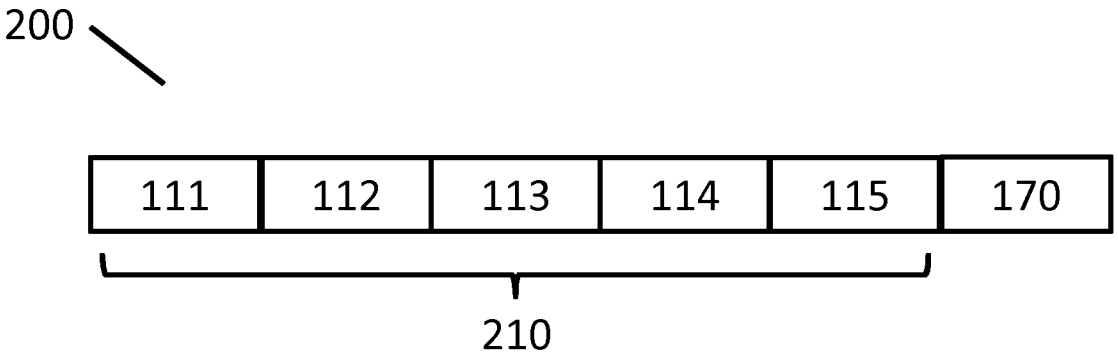
FIG. 2 shows schematically and exemplarily an approximate control command comprising an approximate color point.

In FIG. 2 an example of an approximate control command 200 is shown, comprising the identifiers of five networked lighting devices 210 (i.e. networked lighting devices 111, 112, 113, 114, 115) and an approximate color point 170.

Such a command which does not comprise an intensity level can be sent, for example, when the networked lighting devices need not change their intensity level. One reason for not needing to change intensity level, is when the current intensity level of the networked lighting devices is known and the difference with the target intensity level is minor (i.e. below a predetermined threshold).

Figure 3:
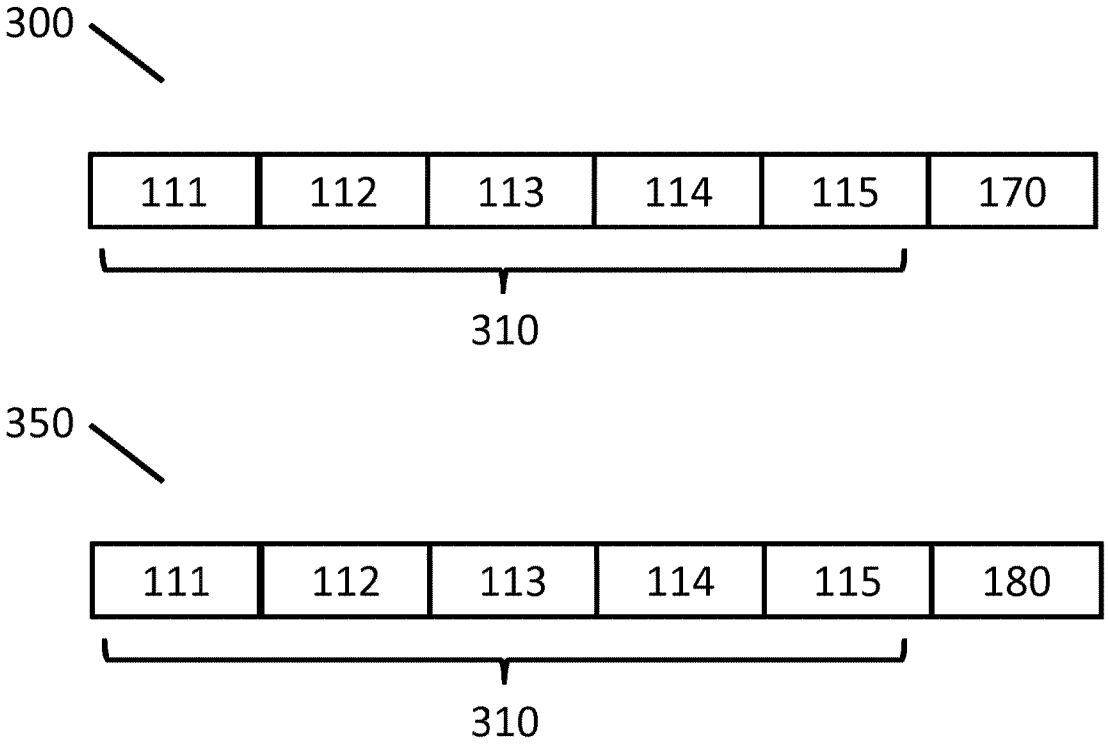
FIG. 3 shows schematically and exemplarily an approximate control command comprising an approximate color point, and a further control command comprising an approximate intensity level.

In FIG. 3 an example of an approximate control command 300 is shown, the approximate control command comprising the identifiers of five networked lighting devices 310 (i.e. networked lighting devices 111, 112, 113, 114, 115) and an approximate color point 170. Also, an example of a further approximate control command 350 is shown, comprising the identifiers of five networked lighting devices 310 and an and an approximate intensity level 180. When, as an example, the current color emitted by the networked lighting devices 111, 112, 113, 114, 115 is very different from the target color point, yet the current intensity emitted by these networked lighting devices is almost the same as the target intensity level, then the use of two control commands as per this example can be barely noticeable. The networked lighting devices 111, 112, 113, 114, 115 change the color of the light emitted first and soon after change the intensity level of the light emitted.

Figure 4:
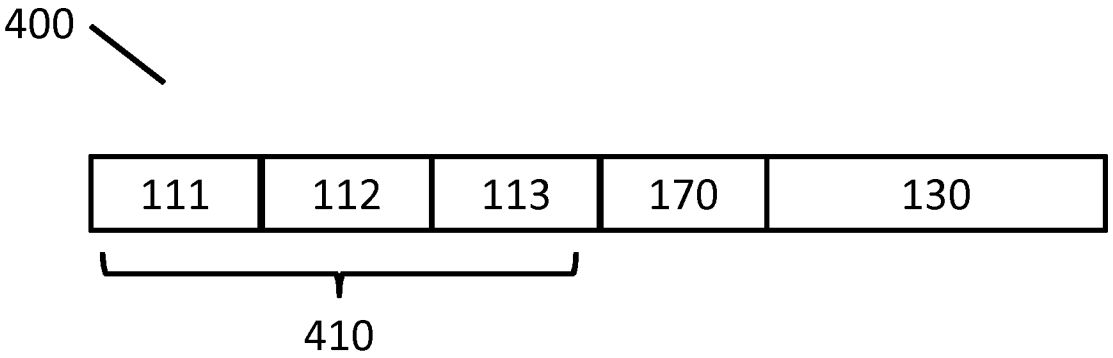
FIG. 4 shows schematically and exemplarily an approximate control command comprising an approximate color point and an approximate intensity level equal to the target intensity level.

In FIG. 4 an example of an approximate control command 400 is shown, the approximate control command comprises the identifiers of three networked lighting devices 410 (i.e. networked lighting devices 111, 112, 113), an approximate color point 170 and a target intensity level 130. Although a control command, as seen in the control command 150 of FIG. 1, can comprise an approximate color point in an approximate color space having an approximate color space resolution and an approximate intensity level in an approximate intensity space having an approximate intensity space resolution, it is also an option to adapt only the resolution of either the color point or the intensity level as seen in this FIG. 4.

Figure 5:
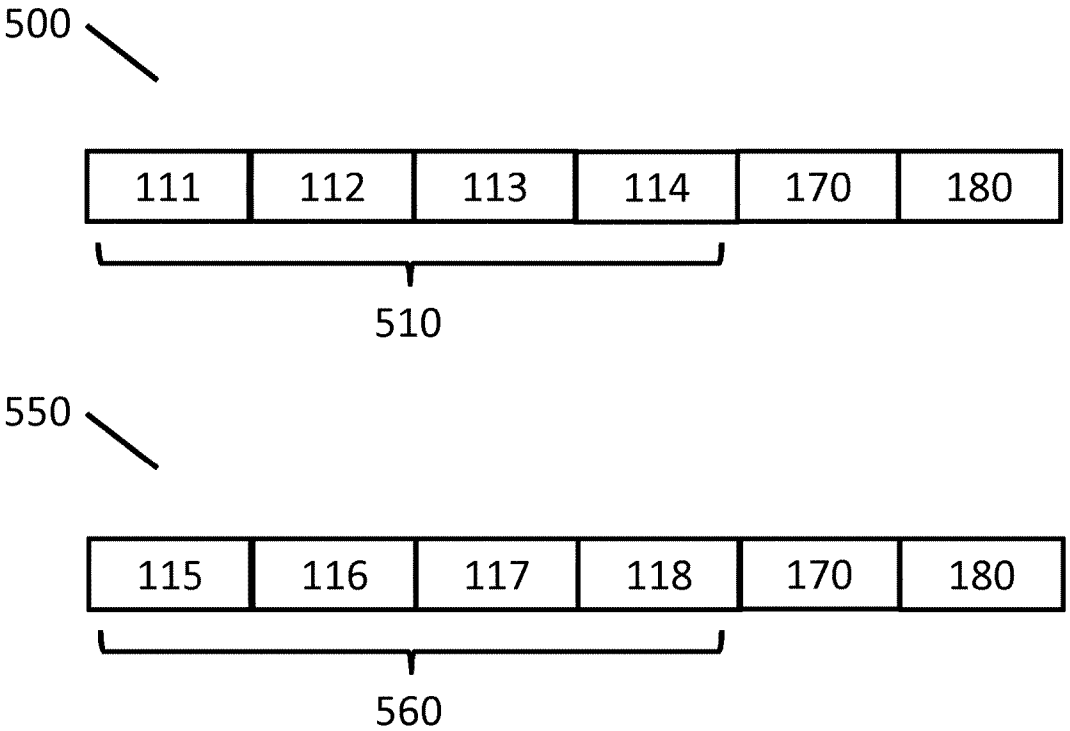
FIG. 5 shows schematically and exemplarily an approximate control command for controlling a first set of networked lighting devices, and a further control command for controlling a second set of networked lighting devices.

In FIG. 5 an example of an approximate control command 500 is shown, the approximate control command comprising the identifiers of four networked lighting devices 510 (i.e. networked lighting devices 111, 112, 113, 114), an approximate color point 170 and an approximate intensity level 180. Also, an example of a further approximate control command 550 is shown, comprising the identifiers of a further four networked lighting devices 560 (i.e. networked lighting devices 115, 116, 117, 118), the approximate color point 170 and the approximate intensity level 180. Based on the difference between the current color point and the target color point for each networked lighting device, networked lighting devices can be grouped. The current color point of certain networked lighting devices will be within a predetermined distance to the target color point (or the approximate color point). In this example, the networked lighting devices 111, 112, 113 are controlled through a control command 400 before a further control command 450 is sent to control networked lighting devices 114, 115, 116. This allows those networked lighting devices where the current color point is furthest removed from the target (or approximate) color point to change their light output at the same time. Although in this example those networked lighting devices with a current color point closest to the target color point (or the approximate color point) are controlled first, alternatively the further approximate control command is sent before the approximate control command of the example above.

Figure 6B:
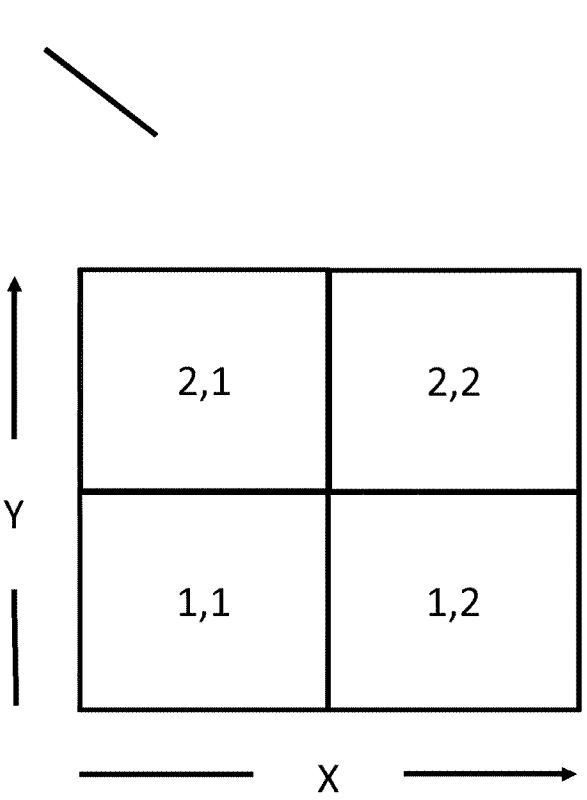
FIGS. 6A-C show schematically and exemplarily the conversion of a target color to an approximate color.
Figure 6A:
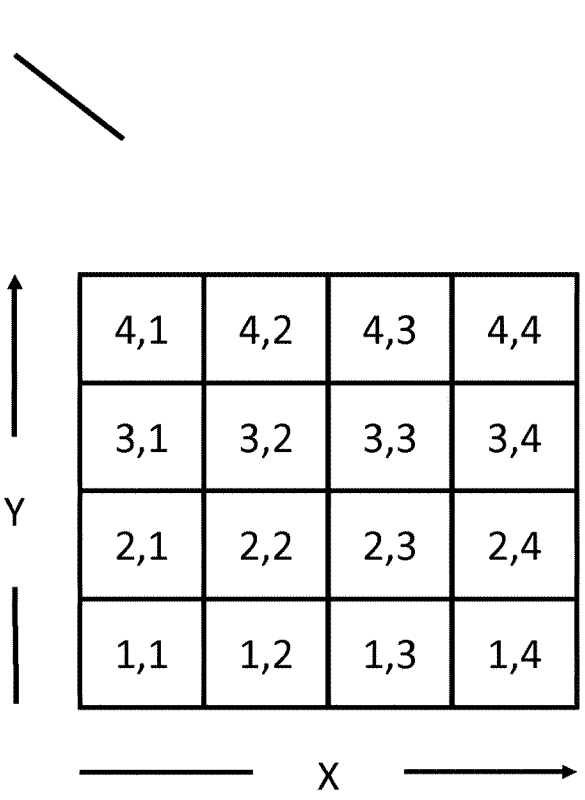
Figure 6C:
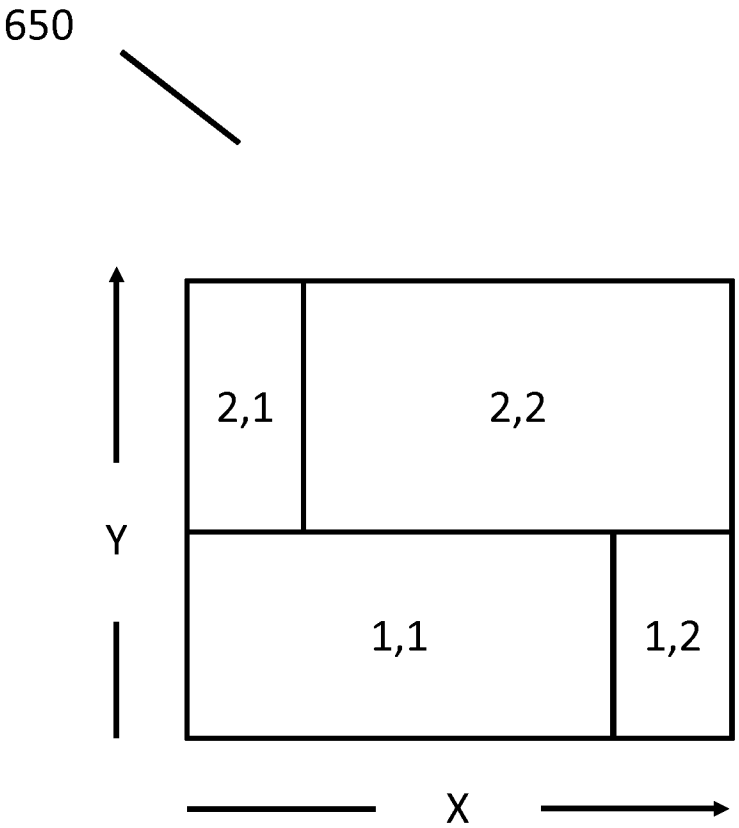

In FIG. 6 an example of a target color space resolution 600 and an example of a first approximate color space resolution 610 and second approximate color space resolution 620 are shown. Each of these color space resolutions 600, 610, 650 comprise color points mapped to an X,Y color space where a gamut of colors are referenced to by X,Y-coordinates. The coordinates are shown in the target color space resolution 600 and first and second approximate color space resolutions 610, 650. In this example the target color space resolution 600 is a 4 by 4 color space resolution, comprising 16 distinct color values which can be represented as a 4 bit value. The first and second approximate color space resolutions 610, 650 of the example are a 2 by 2 color space resolution, comprising 4 distinct values which can be represented as a 2 bit value.

The first approximate color space resolution 610 simply divides the gamut of colors into four colors that can be represented by the X,Y-coordinates. Each of the X,Y-coordinates in the first approximate color space resolution 610 replaces four X,Y-coordinates in the target color space resolution 600. In the second approximate color space resolution 650 a more sophisticated approach is used. As certain color differences are easier to distinguish to the human eye than others. Table 1 below provides an overview, however this is a mere illustration of the principle. Given the simplification used in this example, the effect of certain color differences not being noticeable is only partially true in this example providing a 4 to 2 bit color depth conversion. Application of this principle at higher color depths (e.g. 24 bit color depth) provides more practical application, yet would be overly complex to present here.

TABLE 1

| X, Y-coordinates in target color space (X, Y) and target color point (wavelength) | Mapping to X, Y-coordinates in first approximate color space and approximate color point (wavelength) | Mapping to X, Y-coordinates in second approximate color space and approximate color point (wavelength) |
|---|---|---|
| (1, 1); 380 nm violet | (1, 1) 450 nm violet/blue | (1, 1) 470 nm blue |
| (1, 2); 405 nm violet | (1, 1) 450 nm violet/blue | (1, 1) 470 nm blue |
| (1, 3); 470 nm blue | (1, 2) 495 nm blue/green | (1, 1) 470 nm blue |
| (1, 4); 495 nm blue | (1, 2) 495 nm blue/green | (1, 2) 530 nm green |
| (2, 1); 430 nm violet | (1, 1) 450 nm violet/blue | (1, 1) 470 nm blue |
| (2, 2); 455 nm blue | (1, 1) 450 nm violet/blue | (1, 1) 470 nm blue |
| (2, 3); 520 nm green | (1, 2) 495 nm blue/green | (1, 1) 470 nm blue |
| (2, 4); 545 nm green | (1, 2) 495 nm blue/green | (1, 2) 530 nm green |
| (3, 1); 570 nm yellow | (2, 1) 590 nm yellow/orange | (2, 1) 620 nm orange |
| (3, 2); 595 nm orange | (2, 1) 590 nm yellow/orange | (2, 2) 680 nm red |
| (3, 3); 670 nm red | (2, 2) 680 nm red | (2, 2) 680 nm red |
| (3, 4); 705 nm red | (2, 2) 680 nm red | (2, 2) 680 nm red |
| (4, 1); 620 nm orange | (2, 1) 590 nm yellow/orange | (2, 1) 620 nm orange |
| (4, 2); 645 nm red | (2, 1) 590 nm yellow/orange | (2, 2) 680 nm red |
| (4, 3); 730 nm red | (2, 2) 680 nm red | (2, 2) 680 nm red |
| (4, 4); 755 nm red | (2, 2) 680 nm red | (2, 2) 680 nm red |

Figure 7:
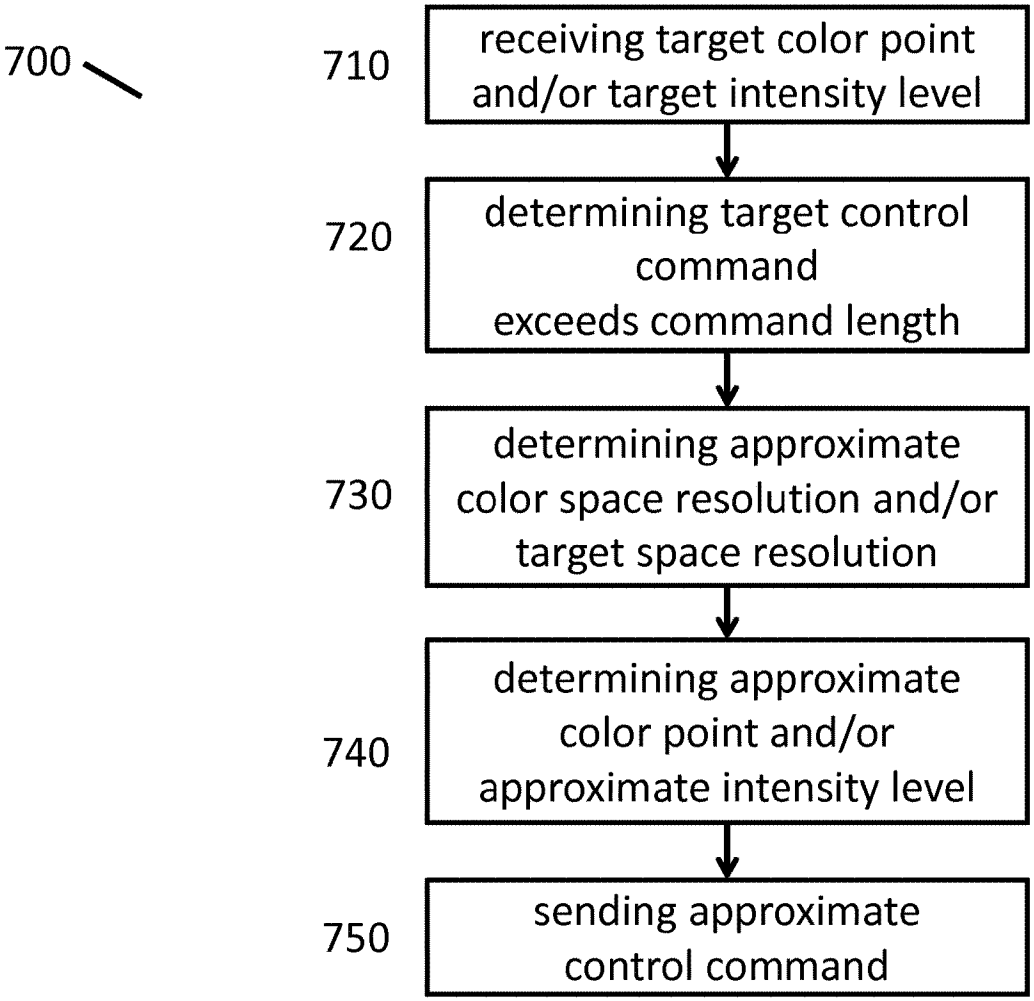
FIG. 7 shows schematically and exemplarily a method for synchronous control of networked lighting devices according to the invention.

In FIG. 7 a method 700 according to the invention is shown. A target color point and/or a target intensity level are received 710. The target color point is in a target color space and the target color space has a target color space resolution. The target intensity level is in a target intensity space and the target intensity space has a target intensity space resolution. Additionally, identifiers for all networked lighting device that are to be synchronously controlled are received. It is determined that a target control command will exceed a maximum control command length 720. This determination is made based on the received identifiers of the networked lighting devices and the received target color point and/or the received target intensity level. An approximate color space resolution and/or an approximate intensity space resolution are determined 730. The approximate color space resolution relates to an approximate color space and the approximate intensity space resolution relates to an approximate intensity space. The approximate color space resolution and/or the approximate intensity space resolution are of a lower resolution than respectively the target color space resolution and/or the target intensity space resolution. The determination of the approximate color space resolution and/or an approximate intensity space resolution 730 is based on the number of networked lighting devices that are to be synchronously controlled, and further based on the maximum control command length. An approximate color point in the approximate color space and/or an approximate intensity level in the approximate intensity space is determined 740 based on respectively the target color point and/or the target intensity level. An approximate control command is sent 750 based on the received identifiers of the networked lighting devices that are to be synchronously controlled and the determined approximate color point and/or the determined approximate intensity level.

Although in the examples specific bit depths have been used in explaining the invention, this does not exclude other bit depths, ranges, values, etc.

Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality.

A single unit or device may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A method for near synchronous control of networked lighting devices, the method comprising:

receiving a target color point, in a target color space having a target color space resolution, or receiving a target intensity level, in a target intensity space having a target intensity space resolution, and further receiving identifiers for networked lighting devices that are to be synchronously controlled to emit light based on the target color point or target intensity level, determining whether a target control command based on the received identifiers of the networked lighting devices and the received target color point or the received target intensity level will exceed a maximum control command length, and if the target control command will exceed the maximum control command length:

determining an approximate color space resolution, relating to an approximate color space, of a lower resolution than the target color space resolution, or an approximate intensity space resolution, relating to an approximate intensity space, of a lower resolution than the target intensity space resolution, based on the number of networked lighting devices that are to be synchronously controlled, and further based on the maximum control command length, determining an approximate color point in the approximate color space based on the target color point or an approximate intensity level in the approximate intensity space based on the target intensity level, and sending an approximate control command based on the received identifiers of the networked lighting devices that are to be synchronously controlled and the approximate color point or the approximate intensity level.

2. The method according to claim 1, wherein the approximate color space is equal to the target color space or wherein the approximate intensity space is equal to the target intensity space.

3. The method according to claim 1, wherein the approximate color space is not equal to the target color space or the approximate intensity space is not equal to the target intensity space; and wherein determining an approximate color space resolution is based on the received target color point or wherein determining an approximate intensity space resolution is based on the received target intensity level.

4. The method according to claim 1, further comprising:

determining the color difference between the received target color point and the current color point or the intensity difference between the received target intensity level and the current intensity level, of the networked lighting devices that are to be controlled;

wherein determining an approximate color space resolution is further based on the color difference or wherein determining an approximate intensity space resolution is further based on the intensity difference.

5. The method according to claim 4, wherein receiving a target color point or target intensity level comprises receiving both a target color point and a target intensity level, the method further comprising:

determining that the color difference between the received target color point and the current color point is below a predetermined color difference threshold;

wherein determining the approximate color space resolution comprises determining the approximate color space resolution to be zero; and wherein the approximate control command comprises the identifier of the networked lighting devices that are to be controlled and the approximate intensity level.

6. The method according to claim 4, wherein receiving a target color point or target intensity level comprises receiving both a target color point and a target intensity level, the method further comprising:

determining that the intensity difference between the received target intensity level and the current intensity level is below a predetermined intensity difference threshold;

wherein determining the approximate intensity space resolution comprises determining the approximate intensity space resolution to be zero; and wherein the approximate control command comprises the identifier of the networked lighting devices that are to be controlled and the approximate color point.

7. The method according to claim 4, further comprising:

determining a ratio of color difference to intensity difference;

sending, to the networked lighting devices, a further control command when the determined ratio is above a predetermined threshold;

wherein the approximate control command comprises the identifier of the networked lighting devices that are to be controlled and the approximate color point; and wherein the further control command comprises the identifier of the networked lighting devices that are to be controlled and the approximate intensity level.

8. The method according to claim 4, further comprising:

determining a ratio of color difference to intensity difference;

sending, to the networked lighting devices, a further control command when the determined ratio is below a predetermined threshold;

wherein the approximate control command comprises the identifier of the networked lighting devices that are to be controlled and the approximate intensity level; and wherein the further control command comprises the identifier of the networked lighting devices that are to be controlled and the approximate color point.

9. The method according to claim 4, further comprising:

determining a first set of networked lighting devices for which the color difference or intensity difference is below respectively a predetermined color difference threshold or predetermined intensity level threshold, determining a second set of networked lighting devices for which the color difference or intensity difference is above respectively the predetermined color difference threshold or the predetermined intensity level threshold, sending, to the networked lighting devices, a further control command;

wherein the approximate control command comprises the identifier of the networked lighting devices of the first set of networked lighting devices that are to be controlled, the approximate color point or the approximate intensity level; and wherein the further control command comprises the identifier of the networked lighting devices of the second set of networked lighting devices that are to be controlled, the approximate color point or the approximate intensity level.

10. The method according to claim 1, wherein the networked lighting devices are part of a mesh network.

11. A non-transitory computer readable medium storing computer program code for near synchronous control of networked lighting devices, the computer program code, when run on a processor, executes the steps of:

receiving a target color point, in a target color space having a target color space resolution, or receiving a target intensity level, in a target intensity space having a target intensity space resolution, and further receiving identifiers for networked lighting devices that are to be synchronously controlled to emit light based on the target color point or target intensity level, determining whether a target control command based on the received identifiers of the networked lighting devices and the received target color point or the received target intensity level will exceed a maximum control command length, and if the target control command will exceed the maximum control command length:

determining an approximate color space resolution, relating to an approximate color space, of a lower resolution than the target color space resolution, or an approximate intensity space resolution, relating to an approximate intensity space, of a lower resolution than the target intensity space resolution, based on the number of networked lighting devices that are to be synchronously controlled, and further based on the maximum control command length, determining an approximate color point in the approximate color space based on the target color point or an approximate intensity level in the approximate intensity space based on the target intensity level, and sending an approximate control command based on the received identifiers of the networked lighting devices that are to be synchronously controlled and the approximate color point or the approximate intensity level.

* * * * *